US007226275B2

(12) United States Patent
Lee et al.

(10) Patent No.: US 7,226,275 B2
(45) Date of Patent: Jun. 5, 2007

(54) VARIABLE CAPACITY ROTARY COMPRESSOR

(75) Inventors: Moon Joo Lee, Suwon (KR); Seung Kap Lee, Suwon (KR); Chun Mo Sung, Hwasung (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 558 days.

(21) Appl. No.: 10/845,194

(22) Filed: May 14, 2004

(65) Prior Publication Data

US 2005/0058562 A1 Mar. 17, 2005

(30) Foreign Application Priority Data

Sep. 17, 2003 (KR) ..... 10-2003-0064515

(51) Int. Cl.
*F04B 49/00* (2006.01)

(52) U.S. Cl. ..... 417/218; 417/221; 418/60

(58) Field of Classification Search ..... 417/218, 417/221; 418/60, 182, 210
See application file for complete search history.

(56) References Cited

U.S. PATENT DOCUMENTS 5,871,342 A 2/1999 Harte et al.
6,796,773 B1 * 9/2004 Choi et al. ..... 417/218
6,860,724 B2 * 3/2005 Cho et al. ..... 417/218
7,104,764 B2 * 9/2006 Lee et al. ..... 417/218
7,140,844 B2 * 11/2006 Lee et al. ..... 417/218
7,144,224 B2 * 12/2006 Kim et al. ..... 417/218
7,150,602 B2 * 12/2006 Choi et al. ..... 417/218
7,150,608 B2 * 12/2006 Cho et al. ..... 417/221
7,153,109 B2 * 12/2006 Cho et al. ..... 417/221

OTHER PUBLICATIONS

U.S. Appl. No. 10/352,000, filed Jan. 28, 2003, Sung-Hea Cho et al., Samsung Electronics Co., Ltd.

* cited by examiner

*Primary Examiner*—Michael Koczo, Jr.
(74) *Attorney, Agent, or Firm*—Staas & Halsey LLP

(57) ABSTRACT

A variable capacity rotary compressor including upper and lower compression chambers having different capacities, and a rotating shaft. Upper and lower eccentric cams are provided on the rotating shaft to be eccentric from the rotating shaft in a same direction. Upper and lower eccentric bushes are fitted over the upper and lower eccentric cams, respectively, to be eccentric from the rotating shaft in opposite directions, with a slot provided at a predetermined position between the upper and lower eccentric bushes. A locking pin functions to change a position of the upper or lower eccentric bush to a maximum eccentric position. The compressor further includes a friction unit to prevent the upper and lower eccentric bushes from slipping. The friction unit is installed at a predetermined portion of the upper eccentric cam, and applies a frictional force to the upper eccentric bush to offset a slip-rotating force of the upper eccentric bush.

17 Claims, 8 Drawing Sheets

VARIABLE CAPACITY ROTARY COMPRESSOR

CROSS-REFERENCE TO RELATED APPLICATIONS

This application claims the benefit of Korean Patent Application No. 2003-64515, filed Sep. 17, 2003 in the Korean Intellectual Property Office, the disclosure of which is incorporated herein by reference.

BACKGROUND OF THE INVENTION

1. Field of the Invention

The present invention relates, in general, to rotary compressors and, more particularly, to a variable capacity rotary compressor, which is designed such that a compression operation is executed in either of two compression chambers having different capacities, by an eccentric unit mounted to a rotating shaft.

2. Description of the Related Art

Generally, a compressor is installed in a refrigeration system, such as an air conditioner and a refrigerator, which operates to cool air in a given space using a refrigeration cycle. In the refrigeration system, the compressor operates to compress a refrigerant which circulates through a refrigeration circuit. A cooling capacity of the refrigeration system is determined according to a compression capacity of the compressor. Thus, when the compressor is designed to vary a compression capacity thereof as desired, the refrigeration system may be operated under an optimum condition considering several factors, such as a difference between a practical temperature and a predetermined temperature, thus allowing air in a given space to be efficiently cooled, and saving energy.

A variety of compressors are used in the refrigeration system. The compressors are typically classified into two types, which are rotary compressors and reciprocating compressors. The present invention relates to the rotary compressor, which will be described in the following.

The conventional rotary compressor includes a hermetic casing, with a stator and a rotor being installed in the hermetic casing. A rotating shaft penetrates through the rotor. An eccentric cam is integrally provided on an outer surface of the rotating shaft. A roller is provided in a compression chamber to be rotated over the eccentric cam.

The rotary compressor constructed as described above is operated as follows. As the rotating shaft rotates, the eccentric cam and the roller execute eccentric rotation in the compression chamber. At the time, a gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

It is an aspect of the present invention to provide a variable capacity rotary compressor which is constructed so that a compression operation is executed in either of two compression chambers having different capacities by an eccentric unit mounted to a rotating shaft, thus varying a compression capacity as desired.

A further aspect of the invention is to provide a variable capacity rotary compressor, which prevents an eccentric bush from rotating faster than a rotating shaft in a specific range, due to variance in pressure of a compression chamber as the rotating shaft rotates.

An another aspect of the invention is to provide a variable capacity rotary compressor which does not generate noise due to slippage and collision of the components of the variable capacity rotary compressor.

Additional aspects and/or advantages of the invention will be set forth in part in the description which follows and, in part, will be obvious from the description, or may be learned by practice of the invention.

The above and/or other aspects are achieved by a variable capacity rotary compressor, including upper and lower compression chambers, a rotating shaft, upper and lower eccentric cams, upper and lower eccentric bushes, a slot, a locking pin, and a friction unit. The upper and lower compression chambers have different capacities. The rotating shaft passes through the upper and lower compression chambers. The upper and lower eccentric cams are provided on the rotating shaft. The upper and lower eccentric bushes are fitted over the upper and lower eccentric cams, respectively. The slot is provided at a predetermined position between the upper and lower eccentric bushes. The locking pin changes a position of the upper or lower eccentric bush to a maximum eccentric position, in cooperation with the slot. The friction unit is installed at a predetermined portion of at least one of the upper and lower eccentric cams, to prevent the upper and lower eccentric bushes from slipping over the upper and lower eccentric cams, respectively.

The friction unit may include a through hole which is formed through the upper eccentric cam in a radial direction thereof, an elastic member which is set in the through hole, and a friction member which is provided at each of opposite ends of the elastic member to apply a frictional force to an inner circumferential surface of the upper eccentric bush.

The elastic member may comprise a coil spring. The coil spring may have an elastic force which is set to allow the frictional force acting on the upper eccentric bush to be larger than a slip-rotating force of the upper or lower eccentric bush and to be smaller than a rotating force of the rotating shaft.

The friction member may comprise a curved outer surface which has a same curvature as the inner circumferential surface of the upper eccentric bush, to effectively apply the frictional force to the upper eccentric bush.

The locking pin may be provided at a predetermined position between the upper and lower eccentric cams to be projected from the rotating shaft. The slot may be provided at the predetermined position between the upper and lower eccentric bushes to receive the locking pin therein, and may have a length to allow, an angle between a first line extending from a first end of the slot to a center of the rotating shaft and a second line extending from a second end of the slot to the center of the rotating shaft, to be 180°.

BRIEF DESCRIPTION OF THE DRAWINGS

These and/or other aspects and advantages of the invention will become apparent and more readily appreciated from the following description of the embodiments of the invention, taken in conjunction with the accompanying drawings of which.

DETAILED DESCRIPTION OF THE PREFERRED EMBODIMENTS

Figure 1:
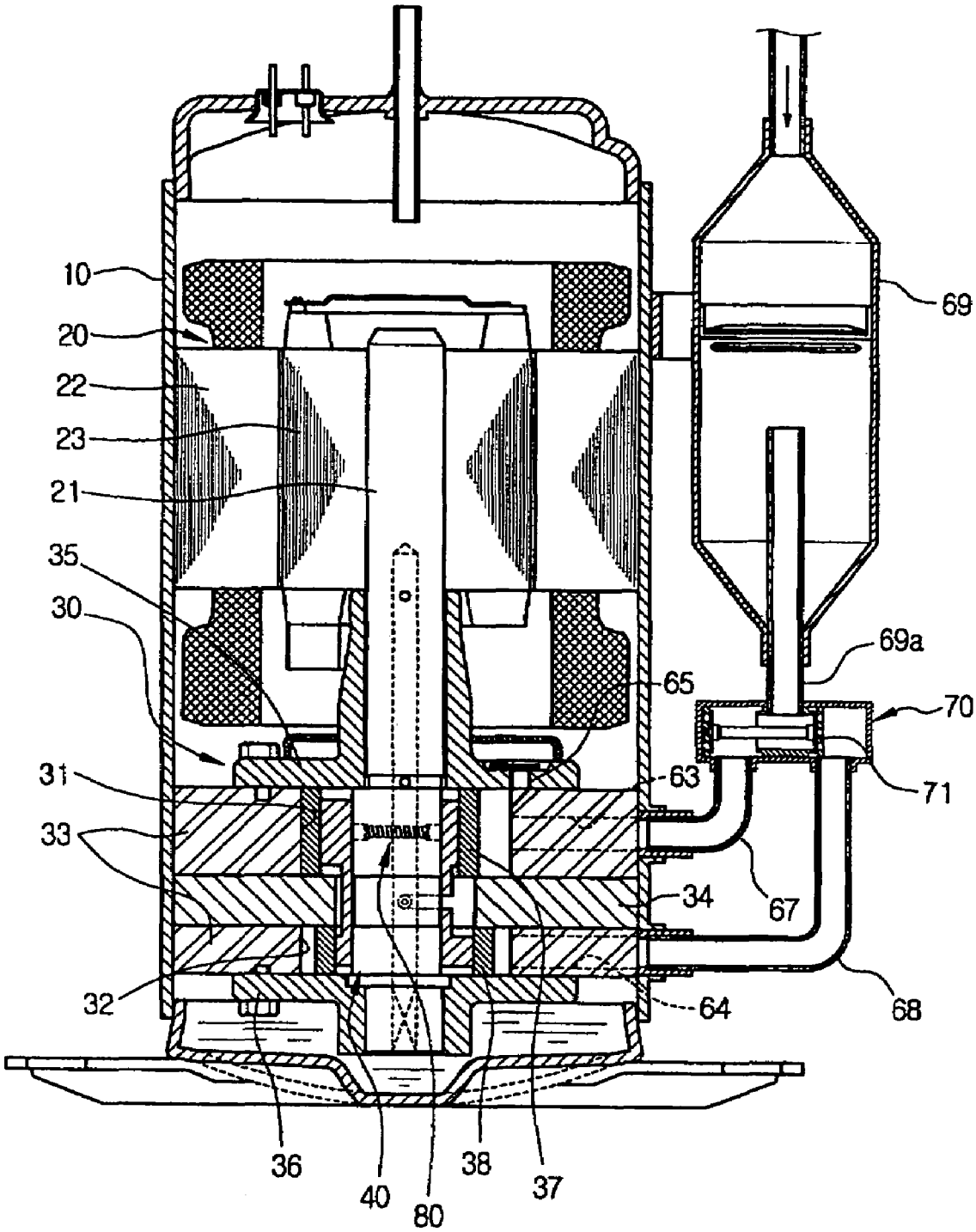
FIG. 1 is a sectional view to illustrate an interior construction of a variable capacity rotary compressor, according to an embodiment of the present invention.

Reference will now be made in detail to the present preferred embodiment of the present invention, examples of which are illustrated in the accompanying drawings, wherein like reference numerals refer to like elements throughout. The embodiment is described below in order to explain the present invention by referring to the figures.

An example of a variable capacity rotary compressor is explained in U.S. patent application Ser. No. 10/352,000, the content of which is incorporated herein by reference. Before presenting a detailed description of the present invention, the variable capacity rotary compressor is briefly discussed.

The construction of the variable capacity rotary compressor is as follows. The compressor includes first and second compression chambers. An eccentric unit is installed in the first and second compression chambers to execute the compression operation in either of the compression chambers, according to a rotating direction of a rotating shaft. The eccentric unit includes first and second eccentric cams, first and second eccentric bushes, first and second rollers, and a locking pin. The first and second eccentric cams are provided on an outer surface of the rotating shaft which passes through the first and second compression chambers. The first and second eccentric bushes are rotatably fitted over the first and second eccentric cams, respectively. The first and second rollers are rotatably fitted over the first and second eccentric bushes, respectively, to compress a gas refrigerant. The locking pin is installed to change a position of one of the first and second eccentric bushes to a position eccentric from a central axis of the rotating shaft, while changing a position of a remaining one of the first and second eccentric bushes to a position concentric with the central axis of the rotating shaft, according to the rotating direction of the rotating shaft.

Thus, when the rotating shaft rotates in a first direction which is counterclockwise in the drawings or a second direction which is clockwise in the drawings, the compression operation is executed in either of the first and second compression chambers having different capacities by the eccentric unit constructed as described above, thus varying the compression capacity of the compressor as desired.

A detailed description of the present invention is now presented.

FIG. 1 is a sectional view to illustrate a variable capacity rotary compressor, according to an embodiment of the present invention. As shown in FIG. 1, the variable capacity rotary compressor includes a hermetic casing 10, with a driving unit 20 and a compressing unit 30 being installed in the hermetic casing 10. The driving unit 20 generates a rotating force, and the compressing unit 30 compresses gas using the rotating force of the driving unit 20. The drivunit 20 includes a cylindrical stator 22, a rotor 23, and a rotating shaft 21. The stator 22 is fixedly mounted to an inner surface of the hermetic casing 10. The rotor 23 is rotatably installed in the stator 22. The rotating shaft 21 is installed to pass through a center of the rotor 23, and rotates along with the rotor 23 in a first direction which is counterclockwise in the drawings or in a second direction which is clockwise in the drawings.

The compressing unit 30 includes a housing 33, upper and lower flanges 35 and 36, and a partition 34. The housing 33 defines upper and lower compression chambers 31 and 32, which are both cylindrical but have different capacities, therein. The upper and lower flanges 35 and 36 are mounted to upper and lower ends of the housing 33, respectively, to rotatably support the rotating shaft 21. The partition 34 is interposed between the upper and lower compression chambers 31 and 32 to partition the upper and lower compression chambers 31 and 32 from each other.

The upper compression chamber 31 is taller than the lower compression chamber 32, thus the upper compression chamber 31 has a larger capacity than the lower compression chamber 32. Therefore, a larger amount of gas is compressed in the upper compression chamber 31 in comparison with the lower compression chamber 32, to allow the rotary compressor to have a variable capacity.

Meanwhile, when the lower compression chamber 32 is taller than the upper compression chamber 31, the lower compression chamber 32 has a larger capacity than the upper compression chamber 31 to allow a larger amount of gas to be compressed in the lower compression chamber 32.

Further, an eccentric unit 40 is placed in the upper and lower compression chambers 31 and 32 to execute a compressing operation in either the upper or lower compression chamber 31 and 32, according to a rotating direction of the rotating shaft 21. According to the present invention, a friction unit 80 is provided at a predetermined position of the eccentric unit 40 to allow the eccentric unit 40 to be smoothly operated without slippage. The construction and operation of the eccentric unit 40 and the friction unit 80 will be described later herein, with reference to FIGS. 2 to 8.

Upper and lower rollers 37 and 38 are placed in the upper and lower compression chambers 31, respectively, to be rotatably fitted over the eccentric unit 40. The upper inlet and outlet 63 and 65 (refer to FIG. 3) are formed at predetermined positions of the housing 33 to communicate with the upper compression chamber 31. The lower inlet and outlet 64 and 66 (refer to FIG. 6) are formed at predetermined positions of the housing 33 to communicate with the lower compression chamber 32.

Figure 3:
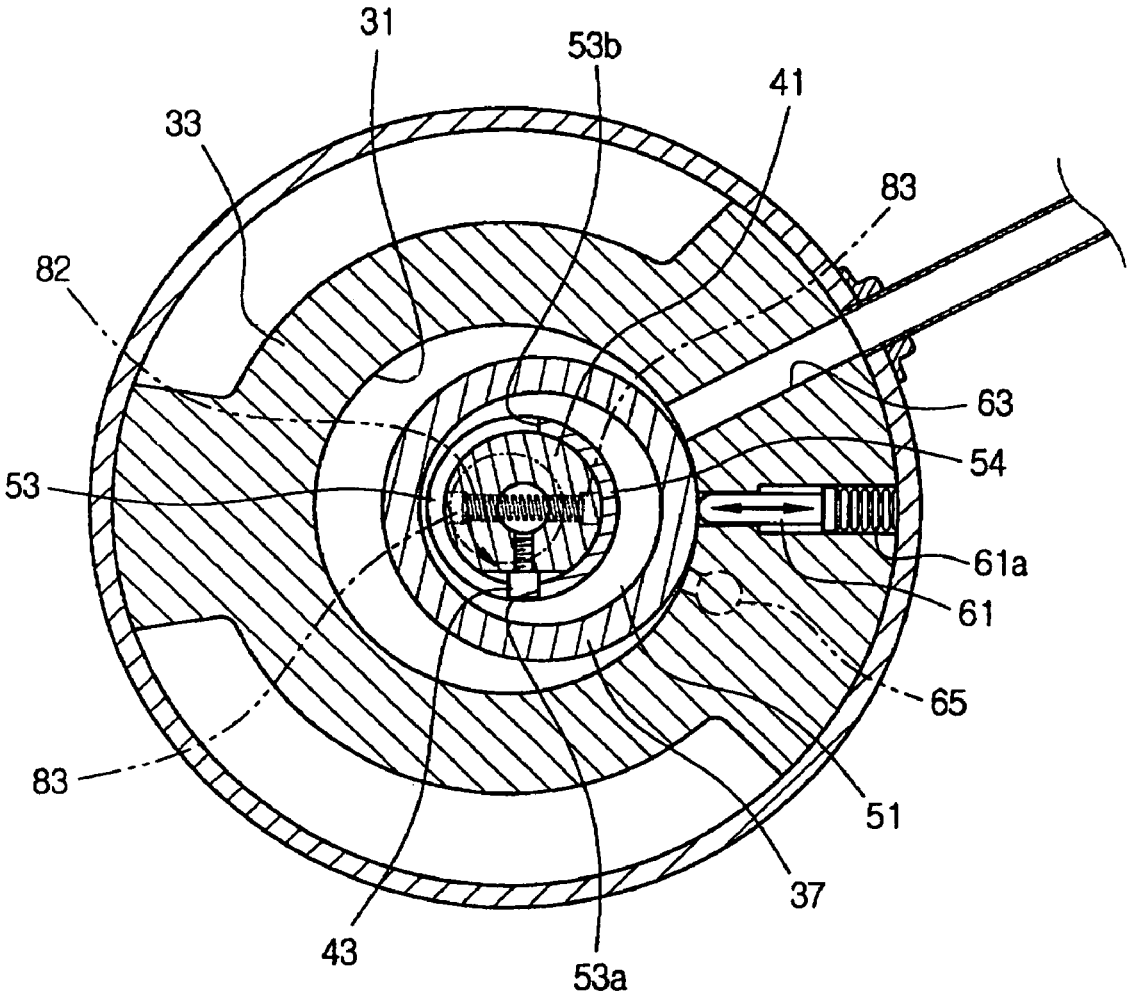
FIG. 3 is a sectional view to illustrate an upper compression chamber where a compression operation is executed without slippage by the eccentric unit of FIG. 2, when the rotating shaft rotates in a first direction.

An upper vane 61 is positioned between the upper inlet and outlet 63 and 65, and is biased in a radial direction by an upper support spring 61*a* to be in close contact with the upper roller 37 (see, FIG. 3). Further, a lower vane 62 is positioned between the lower inlet and outlet 64 and 66, and is biased in a radial direction by a lower support spring 62*a* to be in close contact with the lower roller 38 (see, FIG. 6).

Further, a refrigerant outlet pipe 69*a* extends from an accumulator 69 which contains a refrigerant therein. Of the refrigerant contained in the accumulator 69, only a gas refrigerant flows into the compressor through the refrigerant outlet pipe 69*a*. At a predetermined position of the refrigerant outlet pipe 69*a* is installed a path controller 70. The path controller 70 functions to open an intake path 67 or 68 to supply the gas refrigerant to the upper or lower inlet 63 or 64 of the upper or lower compression chamber 31 or 32 in which a compression operation is executed. A valve 71 is installed in the path controller 70 to be movable in a horizontal direction. The valve 71 functions to open either the intake paths 67 or 68 by a difference in pressure between the intake path 67 connected to the upper inlet 63 and the intake path 68 connected to the lower inlet 64, to supply the gas refrigerant to the upper inlet 63 or lower inlet 64.

The construction of the rotating shaft 21 and the eccentric unit 40 according to an embodiment of the present invention will be described in the following with reference to FIG. 2.

Figure 2:
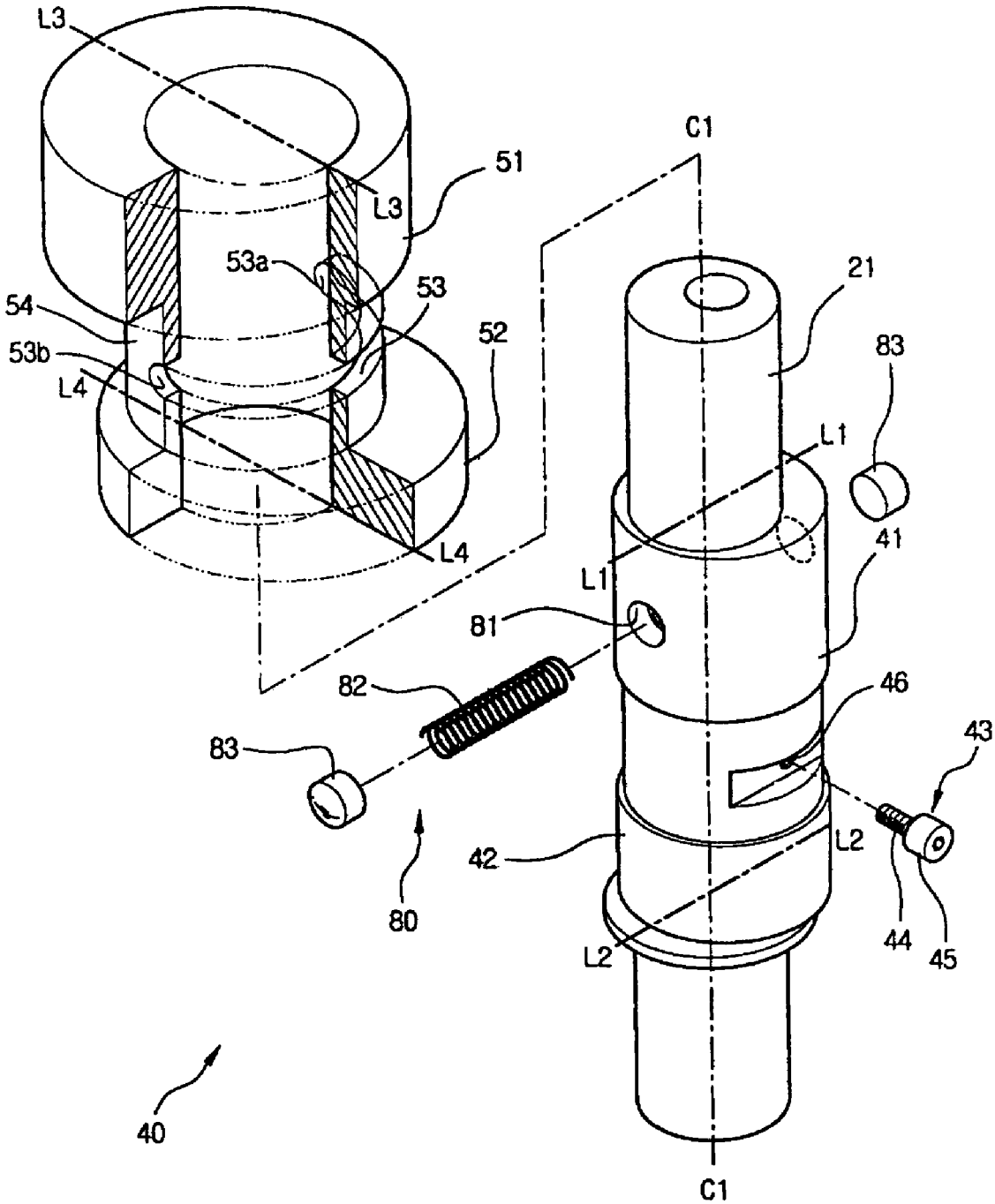
FIG. 2 is a perspective view of an eccentric unit included in the compressor of FIG. 1, in which upper and lower eccentric bushes of the eccentric unit are separated from a rotating shaft.

FIG. 2 is a perspective view of the eccentric unit 40 included in the compressor of FIG. 1, in which the upper and lower eccentric bushes 51 and 52 of the eccentric unit 40 are separated from the rotating shaft 21. As shown in FIG. 2, the eccentric unit 40 includes upper and lower eccentric cams 41 and 42. The upper and lower eccentric cams 41 and 42 are provided on the rotating shaft 21 to be placed in the upper and lower compression chambers 31 and 32, respectively. Upper and lower eccentric bushes 51 and 52 are fitted over the upper and lower eccentric cams 41 and 42, respectively. A locking pin 43 is provided at a predetermined position between the upper and lower eccentric cams 41 and 42. A slot 53 of a predetermined length is provided at a predetermined position between the upper and lower eccentric bushes 51 and 52 to engage with the locking pin 43. The eccentric unit 40 also includes the friction unit 80. The friction unit 80 prevents either the upper or lower eccentric bush 51 or 52 from slipping over the upper or lower eccentric cam 41 or 42 at a predetermined position.

The upper and lower eccentric cams 41 and 42 are integrally fitted over the rotating shaft 21 to be eccentric from the central axis C1—C1 of the rotating shaft 21. The upper and lower eccentric cams 41 and 42 are positioned to correspond an upper eccentric line L1—L1 of the upper eccentric cam 41 to a lower eccentric line L2—L2 of the lower eccentric cam 42. In this case, the upper eccentric line L1—L1 is a line to connect a maximum eccentric part of the upper eccentric cam 41, which is maximally projected from the rotating shaft 21, to a minimum eccentric part of the upper eccentric cam 41, which is minimally projected from the rotating shaft 21. Meanwhile, the lower eccentric line L2—L2 is defined as a line to connect a maximum eccentric part of the lower eccentric cam 42, which is maximally projected from the rotating shaft 21, to a minimum eccentric part of the lower eccentric cam 42, which is minimally projected from the rotating shaft 21.

The locking pin 43 includes a threaded shank 44 and a head 45. The head 45 has slightly larger diameter than the shank 44, and is formed at an end of the shank 44. Further, a threaded hole 46 is formed on the rotating shaft 21 between the upper and lower eccentric cams 41 and 42 to be at about 90° with the maximum eccentric parts of the upper and lower eccentric cams 41 and 42. The threaded shank 44 of the locking pin 43 is inserted into the threaded hole 46 in a screw-type fastening method to lock the locking pin 43 to the rotating shaft 21.

The upper and lower eccentric bushes 51 and 52 are integrated with each other by a connecting part 54 which connects the upper and lower eccentric bushes 51 and 52 to each other. The slot 53 is formed around a part of the connecting part 54, and has a width which is slightly larger than a diameter of the head 45 of the locking pin 43.

Thus, when the upper and lower eccentric bushes 51 and 52 which are integrally connected to each other by the connecting part 54 are fitted over the rotating shaft 21 and the locking pin 43 is inserted to the threaded hole 46 of the rotating shaft 21 through the slot 53, the locking pin 43 is mounted to the rotating shaft 21 while engaging with the slot 53.

When the rotating shaft 21 rotates in the first or second direction in such a state, the locking pin 43 comes into contact with the first or second end 53*a* or 53*b* of the slot 53. At this time, the upper and lower eccentric bushes 51 and 52 rotate in the first or second direction along with the rotating shaft 21.

In this case, an eccentric line L3—L3, which connects the maximum eccentric part of the upper eccentric bush 51 to the minimum eccentric part thereof, is approximately 90° from a line which connects the first end 53*a* of the slot 53 to a center of the connecting part 54. Meanwhile, an eccentric line L4—L4, which connects the maximum eccentric part of the lower eccentric bush 52 to the minimum eccentric part thereof, is approximately 90° from a line which connects the second end 53*b* of the slot 53 to the center of the connecting part 54.

Further, the eccentric line L3—L3 of the upper eccentric bush 51 and the eccentric line L4—L4 of the lower eccentric bush 52 are positioned on a same plane, but the maximum eccentric part of the upper eccentric bush 51 is arranged to be opposite to the maximum eccentric part of the lower eccentric bush 52. An angle between a line extending from the first end 53*a* of the slot 53 to a center of the rotating shaft 21 and a line extending from the second end 53*b* of the slot 53 to the center of the rotating shaft 21 is approximately 180°. The slot 53 is formed around a part of the connecting part 54.

When the locking pin 43 is locked by the first end 53*a* of the slot 53 and the upper eccentric bush 51 rotates along with the rotating shaft 21 in the first direction (of course, the lower eccentric bush 52 also rotates), the maximum eccentric part of the upper eccentric cam 41 contacts the maximum eccentric part of the upper eccentric bush 51. Thus, the upper eccentric bush 51 rotates along with the rotating shaft 21 in the first direction while being maximally eccentric from the rotating shaft 21 (see, FIG. 3). Meanwhile, in the case of the lower eccentric bush 52, the maximum eccentric part of the lower eccentric cam 42 contacts the minimum eccentric part of the lower eccentric bush 52. Thus, the lower eccentric bush 52 rotates along with the rotating shaft 21 in the first direction while being concentric with the rotating shaft 21 (see, FIG. 4).

Conversely, when the locking pin 43 is locked by the second end 53*b* of the slot 53 and the lower eccentric bush 52 rotates along with the rotating shaft 21 in the second direction, the maximum eccentric part of the lower eccentric cam 42 contacts the maximum eccentric part of the lower eccentric bush 52. Thus, the lower eccentric bush 51 rotates along with the rotating shaft 21 in the second direction while being maximally eccentric from the rotating shaft 21 (see, FIG. 6). Meanwhile, in the case of the upper eccentric bush 51, the maximum eccentric part of the upper eccentric cam 41 contacts the minimum eccentric part of the upper eccentric bush 51. Thus, the upper eccentric bush 51 rotates along with the rotating shaft 21 in the second direction while being concentric with the rotating shaft 21 (see, FIG. 7).

In the eccentric unit 40 constructed as described above, the friction unit 80 is installed at a predetermined position of the upper eccentric cam 41 to allow the upper and lower eccentric bushes 51 and 52 to rotate at a same speed as the rotating shaft 21 while not slipping over the upper and lower eccentric cams 41 and 42, respectively.

The friction unit 80 includes a through hole 81, an elastic member 82, and friction members 83. The through hole 81, having a constant diameter, is formed in a diametric direction through the upper eccentric cam 41. The elastic member 82 is set in the through hole 81 to provide an elastic force. The friction members 83 are provided at opposite ends of the elastic member 82 to be elastically biased outward, so that friction arises on an inner circumferential surface of the upper eccentric bush 51, due to a contact between the inner circumferential surface of the upper eccentric bush 51 and the friction members 83.

In an embodiment of the invention, the elastic member 82 is a coil spring which has a predetermined elastic force. The elastic force $F_e$ of the elastic member 82 is set to allow the frictional force $F_r$ of the friction member 83 acting on the upper eccentric bush 51 to be larger than a slip-rotating force $F_s$ of the upper or lower eccentric bush 51 or 52 and to be smaller than a rotating force of the rotating shaft 21 (see, FIGS. 5 and 8).

The elastic member 82 having the elastic force $F_e$ allows the upper and lower eccentric bushes 51 and 52 to rotate at a same speed as the upper and lower eccentric cams 41 and 42 without slippage. However, where the rotating direction of the rotating shaft 21 changes, the locking pin 82 which is locked by the first or second end 53*a* or 53*b* of the slot 53, moves to a desired position within the slot 53, regardless of the friction members 83 biased by the elastic member 82.

An outer surface of the friction member 83 is a curved surface which has a same curvature as the inner circumferential surface of the upper eccentric bush 51. Thus, the outer surface of the friction member 83 completely contacts the upper eccentric bush 51, so that the frictional force $F_e$ effectively acts on the upper eccentric bush 51.

Although not shown in FIG. 2, the friction unit may be constructed in such a way that the friction members are fixed to the elastic member to allow the elastic member and the friction members to be easily set in the through hole. Further, the friction unit may be constructed in such a way that the upper eccentric cam is provided with two holes which do not communicate with each other. In each of the holes are set one elastic member and one friction member.

The operation of compressing a gas refrigerant in the upper or lower compression chamber by the eccentric unit according to an embodiment of the present invention will be described in the following with reference to FIGS. 3 to 8.

Figure 4:
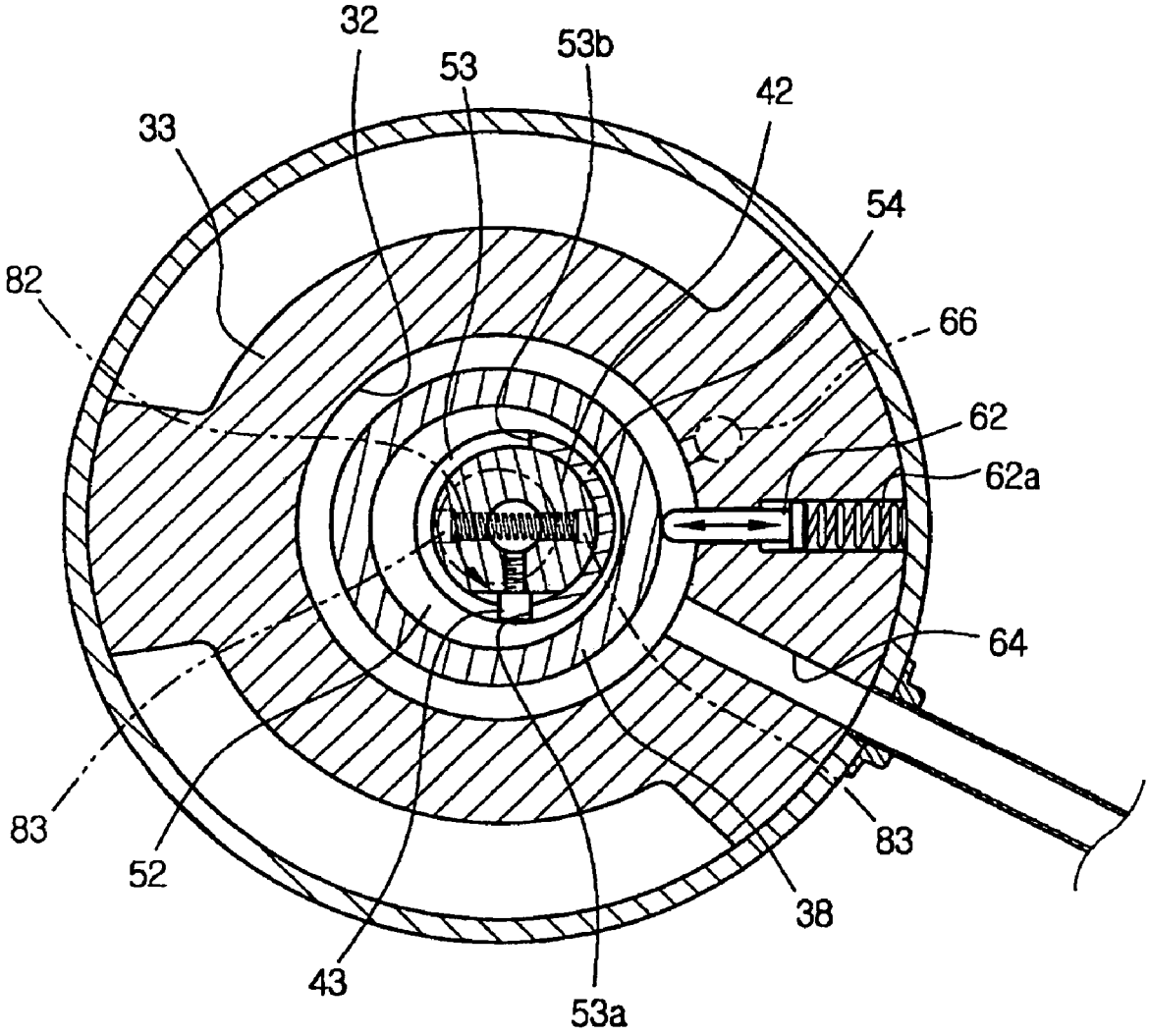
FIG. 4 is a sectional view, corresponding to FIG. 3, to illustrate a lower compression chamber where an idle operation is executed by the eccentric unit of FIG. 2, when the rotating shaft rotates in the first direction.
Figure 5:
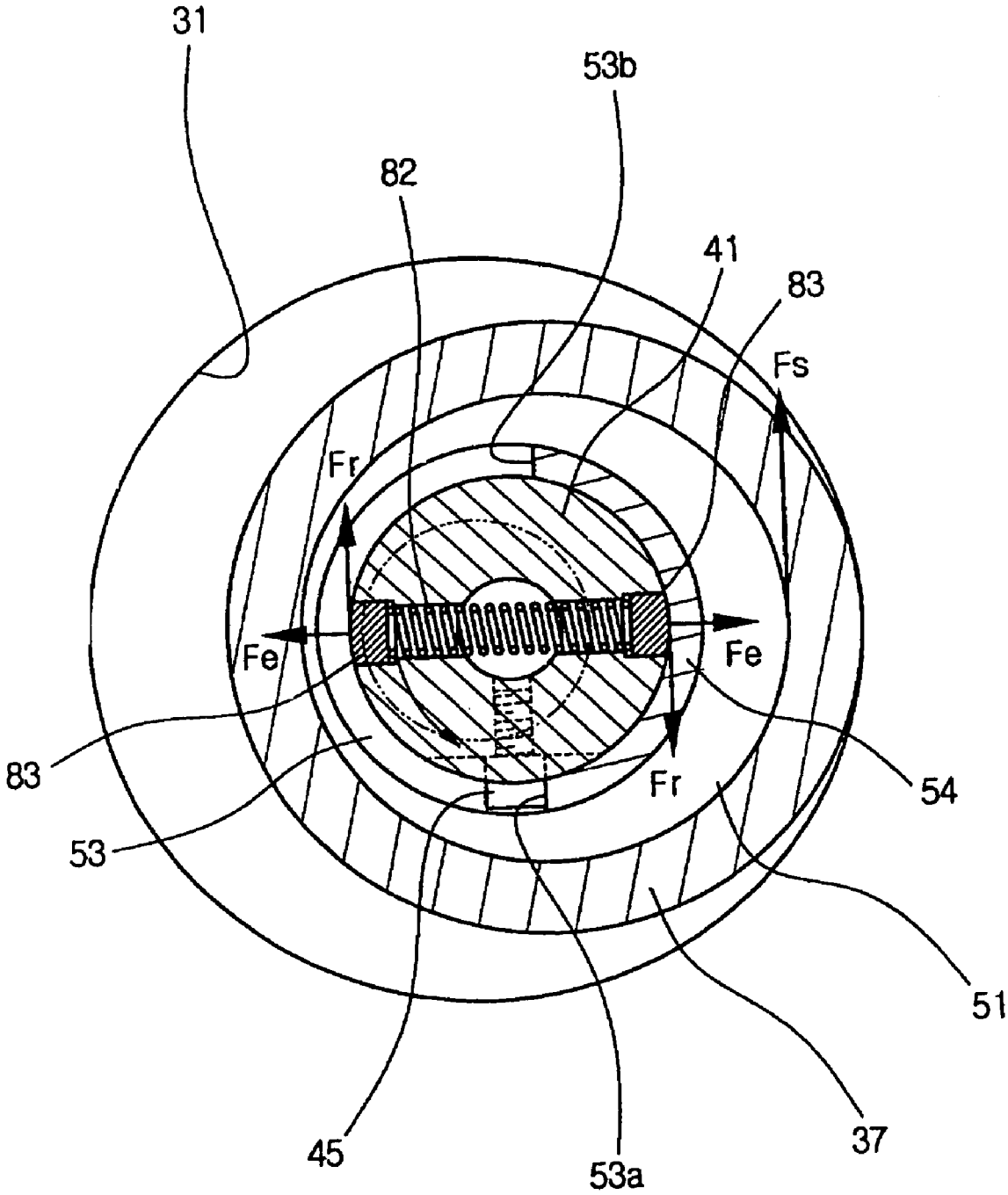
FIG. 5 is a sectional view to illustrate the upper eccentric bush which rotates without slippage by the eccentric unit of FIG. 2, when the rotating shaft rotates in the first direction.

FIG. 3 is a sectional view to illustrate the upper compression chamber where the compression operation is executed without slippage by the eccentric unit of FIG. 2, when the rotating shaft rotates in the first direction. FIG. 4 is a sectional view, corresponding to FIG. 3, to illustrate the lower compression chamber where the idle operation is executed by the eccentric unit of FIG. 2, when the rotating shaft rotates in the first direction. FIG. 5 is a sectional view to show the upper eccentric bush which rotates without slippage by the eccentric unit of FIG. 2, when the rotating shaft rotates in the first direction.

As shown in FIG. 3, when the rotating shaft 21 rotates in the first direction which is counterclockwise in FIG. 3, the locking pin 43 projected from the rotating shaft 21 rotates at a predetermined angle while engaging with the slot 53 which is provided at a predetermined position between the upper and lower eccentric bushes 51 and 52. When the locking pin 43 rotates at the predetermined angle, and is locked by the first end 53*a* of the slot 53, the upper eccentric bush 51 rotates along with the rotating shaft 21. At this time, since the lower eccentric bush 52 is integrally connected to the upper eccentric bush 51 by the connecting part 54, the lower eccentric bush 52 also rotates along with the upper eccentric bush 51.

When the locking pin 43 contacts the first end 53*a* of the slot 53, the maximum eccentric part of the upper eccentric cam 41 is aligned with the maximum eccentric part of the upper eccentric bush 51. In this case, the upper eccentric bush 51 rotates while being maximally eccentric from the central axis C1—C1 of the rotating shaft 21. Therefore, the upper roller 37 rotates while being in contact with an inner surface of the housing 33 to define the upper compression chamber 31 to execute the compression operation.

Simultaneously, as shown in FIG. 4, the maximum eccentric part of the lower eccentric cam 42 contacts with the minimum eccentric part of the lower eccentric bush 52. In this case, the lower eccentric bush 52 rotates while being concentric with the central axis C1—C1 of the rotating shaft 21. Therefore, the lower roller 38 rotates while being spaced apart from the inner surface of the housing 33, which defines the lower compression chamber 32, by a predetermined interval. Thus the compression operation is not executed.

When the rotating shaft 21 rotates in the first direction, the gas refrigerant flowing to the upper compression chamber 31 through the upper inlet 63 is compressed by the upper roller 37 in the upper compression chamber 31 having a larger capacity, and subsequently is discharged from the upper compression chamber 31 through the upper outlet 65. On the other hand, the compression operation is not executed in the lower compression chamber 32 having a smaller capacity. In this case, the rotary compressor is operated in a larger capacity compression mode.

Meanwhile, as shown in FIG. 3, when the upper roller 37 comes into contact with the upper vane 61, the operation of compressing the gas refrigerant is completed and an operation of drawing the gas refrigerant is started. At this time, some of the compressed gas, which was not discharged from the upper compression chamber 31 through the upper outlet 65, returns to the upper compression chamber 31 and is expanded again to apply a pressure to the upper roller 37 and the upper eccentric bush 51 in a rotating direction of the rotating shaft 21.

If the upper eccentric bush 51 rotates faster than the rotating shaft 21, then the upper eccentric bush 51 slips over the upper eccentric cam 41. When the rotating shaft 21 further rotates in such a state, the locking pin 43 collides with the first end 53*a* of the slot 53 to make the upper eccentric bush 51 rotate at a same speed as that of the rotating shaft 21. Noise may be generated and the locking pin 43 and the slot 53 may be damaged, due to the collision between the locking pin 43 and the slot 53. When the upper roller 37 comes into contact with the upper vane 61, some of the gas refrigerant returns to the upper compression chamber 31 through the upper outlet 65 and is expanded again to generate a pressure The pressure acts on the upper eccentric bush 51 in the rotating direction of the rotating shaft 21 which is the first direction, thus the upper eccentric bush 51 slips over the upper eccentric cam 41.

However, in the present invention the friction unit 80 installed at the predetermined position of the upper eccentric cam 41 applies the frictional force $F_r$ to the inner circumferential surface of the upper eccentric bush 51, in a direction opposite to a direction where the upper eccentric bush 51 may rotate due to the slippage to prevent the upper eccentric bush 51 from slipping over the upper eccentric cam 41.

As shown in FIG. 5, the friction members 83 of the friction unit 80 come into close contact with the inner circumferential surface of the upper eccentric bush 51 by the elastic member 82 to apply the elastic force $F_e$ of the elastic member 82 in the radial direction. At this time, the frictional force $F_r$ is applied from each of the friction members 83 to the inner circumferential surface of the upper eccentric bush 51 in a direction opposite to the rotating direction of the upper eccentric bush 51.

When a centrifugal force (not shown) generated by a high-speed rotation of the rotating shaft 21 is added to the elastic force $F_e$, the frictional force $F_r$ is increased to completely offset the slip-rotating force $F_s$ of the upper eccentric bush 51. Therefore, the upper eccentric bush 51 rotates at the same speed as the rotating shaft 21 without the slippage.

To execute the compression operation in the lower compression chamber 32 after the upper eccentric bush 51 has executed the compression operation in the upper compression chamber 31 without the slippage by the eccentric unit 40 according to the present invention, the rotating shaft 21 is stopped to change the rotating direction thereof to the second direction. The compression operation executed in the lower compression chamber 32 will be described in the following with reference to FIGS. 6 to 8.

Figure 6:
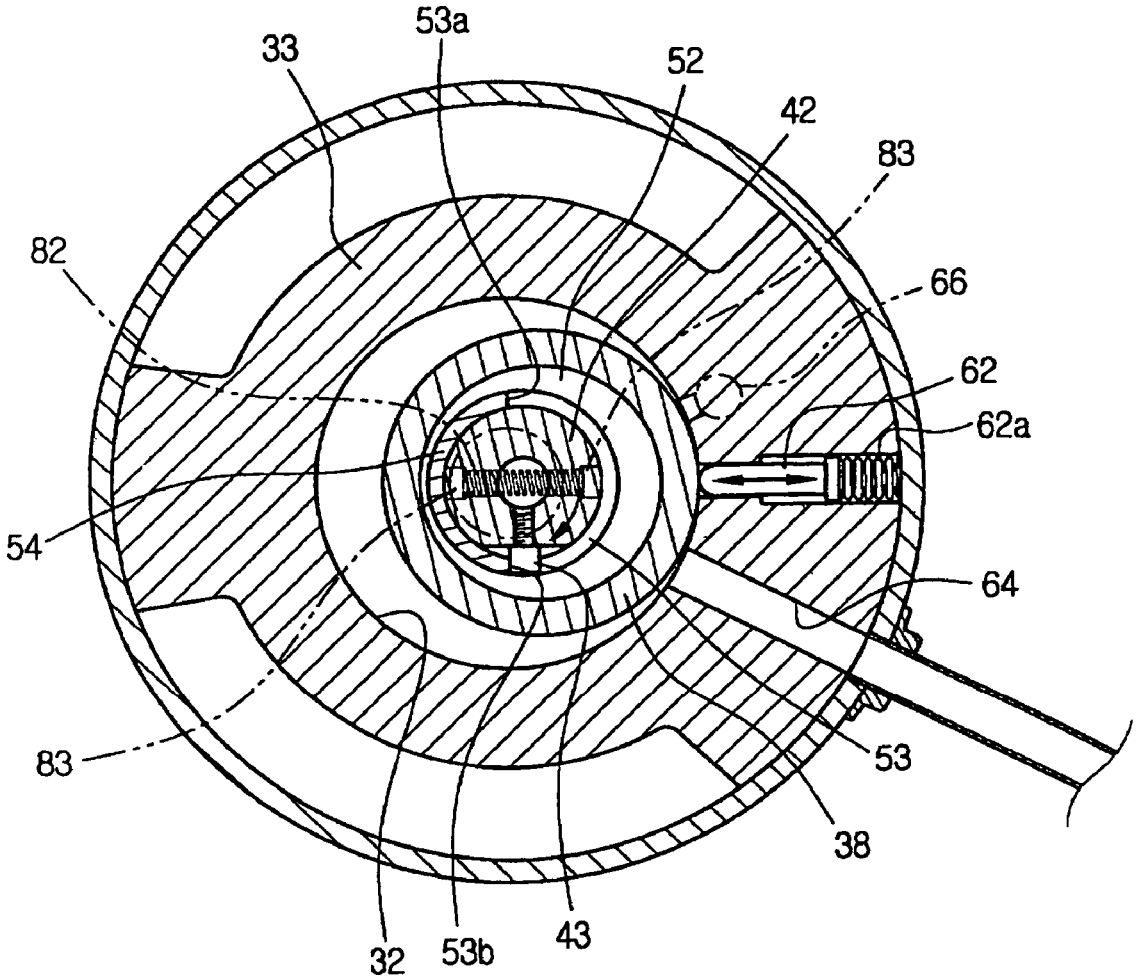
FIG. 6 is a sectional view to illustrate the lower compression chamber where the compression operation is executed without the slippage by the eccentric unit of FIG. 2, when the rotating shaft rotates in a second direction.
Figure 7:
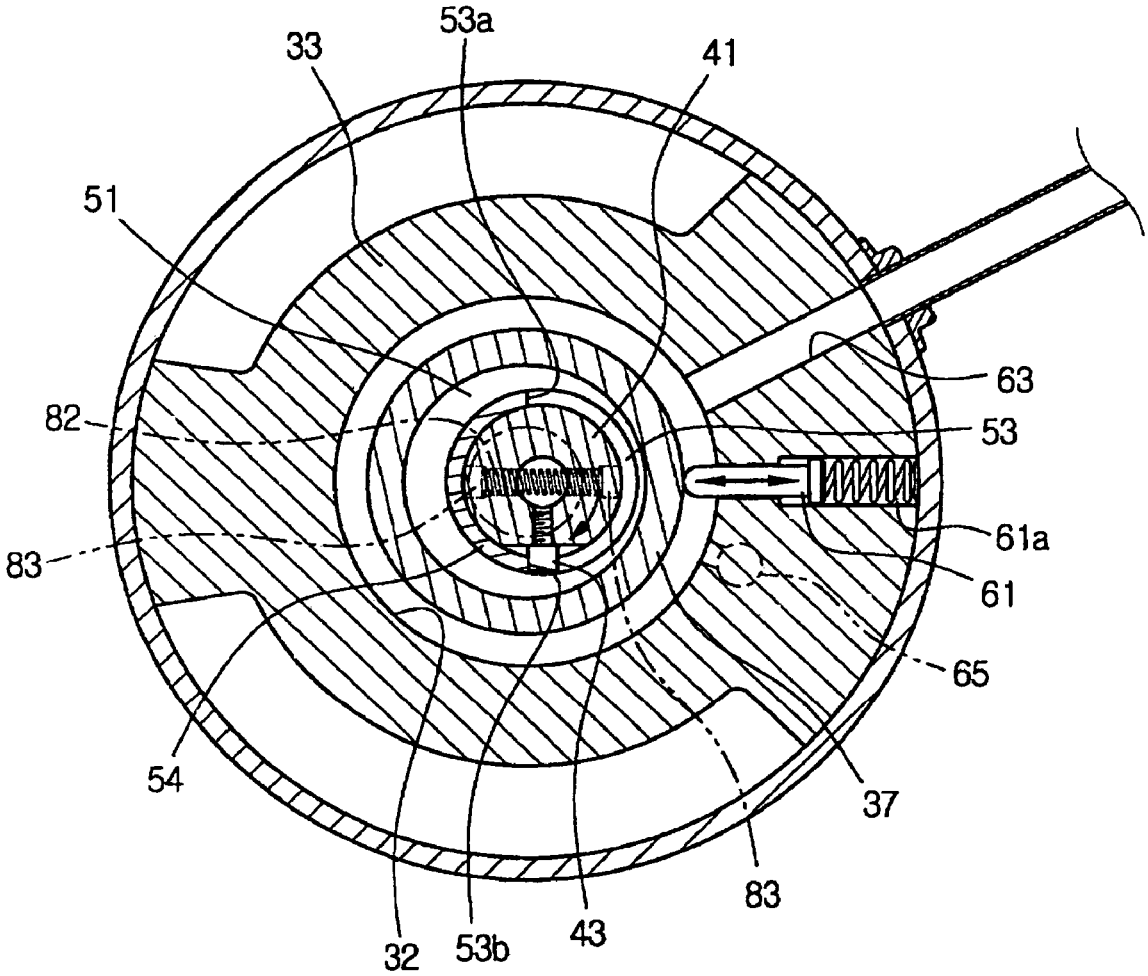
FIG. 7 is a sectional view, corresponding to FIG. 6, to illustrate the upper compression chamber where the idle operation is executed by the eccentric unit of FIG. 2, when the rotating shaft rotates in the second direction.
Figure 8:
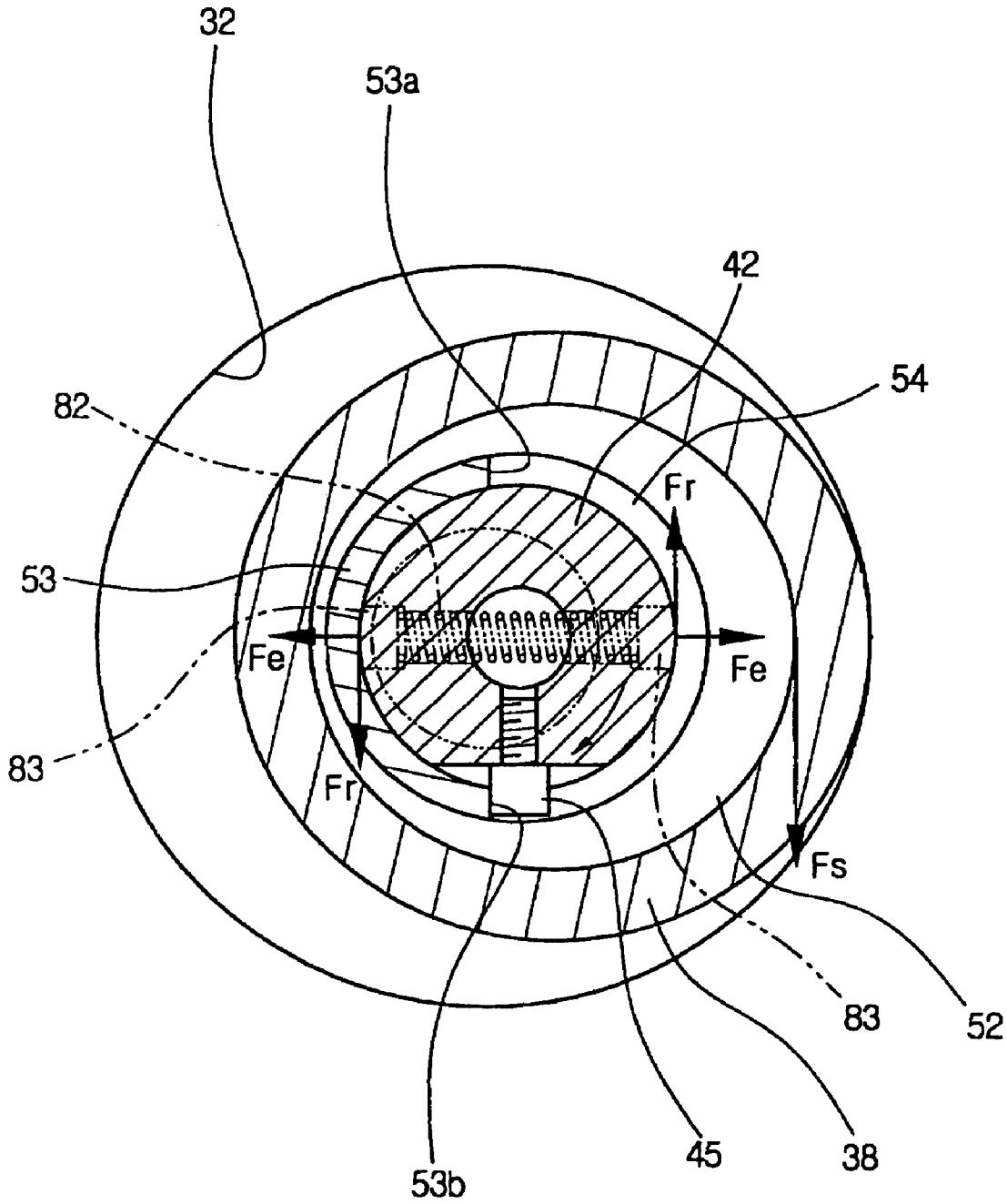
FIG. 8 is a sectional view to illustrate the lower eccentric bush which rotates without the slippage by the eccentric unit of FIG. 2, when the rotating shaft rotates in the second direction.

FIG. 6 is a sectional view to illustrate the lower compression chamber where the compression operation is executed without the slippage by the eccentric unit of FIG. 2, when the rotating shaft rotates in the second direction. FIG. 7 is a sectional view, corresponding to FIG. 6, to show the upper compression chamber where the idle operation is executed by the eccentric unit of FIG. 2, when the rotating shaft rotates in the second direction. FIG. 8 is a sectional view to show the lower eccentric bush which rotates without the slippage by the eccentric unit of FIG. 2, when the rotating shaft rotates in the second direction.

As shown in FIG. 6, when the rotating shaft 21 rotates in the second direction which is clockwise in FIG. 6, the compression operation is executed in only the lower compression chamber 32, oppositely to the operation of FIGS. 3 and 4 to show the compression operation executed in only the upper compression chamber 31.

When the rotating direction of the rotating shaft 21 is changed at a low speed, the rotating force of the rotating shaft 21 overcomes the frictional force $F_r$ acting on the inner circumferential surface of the upper eccentric bush 51. Thus, the locking pin 43 projected from the rotating shaft 21 moves to the second end 53*b* of the slot 53 and then is locked by the second end 53*b*.

In this case, the maximum eccentric part of the lower eccentric cam 42 contacts the maximum eccentric part of the lower eccentric bush 52, thus the lower eccentric bush 52 rotates along with the rotating shaft 21 while being maximally eccentric from the central axis C1—C1 of the rotating shaft 21. Therefore, the lower roller 38 rotates while being in contact with the inner surface of the housing 33 which defines the lower compression chamber 32, thus executing the compression operation.

Simultaneously, as shown in FIG. 7, the maximum eccentric part of the upper eccentric cam 41 contacts with the minimum eccentric part of the upper eccentric bush 51. In this case, the upper eccentric bush 51 rotates while being concentric with the central axis C1—C1 of the rotating shaft 21. Therefore, the upper roller 37 rotates while being spaced apart from the inner surface of the housing 33, which defines the upper compression chamber 31, by a predetermined interval. Thus, the compression operation is not executed.

The gas refrigerant flowing to the lower compression chamber 32 through the lower inlet 64 is compressed by the lower roller 38 in the lower compression chamber 32 having a smaller capacity, and subsequently is discharged from the lower compression chamber 32 through the lower outlet 66. On the other hand, the compression operation is not executed in the upper compression chamber 31 having a larger capacity. Therefore, the rotary compressor is operated in a smaller capacity compression mode.

Meanwhile, as shown in FIG. 6, when the lower roller 38 comes into contact with the lower vane 62, the operation of compressing the gas refrigerant is completed and an operation of drawing the gas refrigerant is started. At this time, some of the compressed gas, which was not discharged from the lower compression chamber 32 through the lower outlet 66, returns to the lower compression chamber 32 and is expanded again to apply a pressure to the lower roller 38 and the lower eccentric bush 52 in a rotating direction of the rotating shaft 21. At this time, the lower eccentric bush 52 rotates faster than the rotating shaft 21, to cause the lower eccentric bush 52 to slip over the lower eccentric cam 42.

When the rotating shaft 21 further rotates in such a state, the locking pin 43 collides with the second end 53*b* of the slot 53 to make the lower eccentric bush 52 rotate at a same speed as that of the rotating shaft 21. At this time, noise may be generated and the locking pin 43 and the slot 53 may be damaged, due to the collision between the locking pin 43 and the slot 53.

However, in the present invention, the friction unit 80 applies the frictional force $F_r$ to the lower eccentric bush 52, in a same manner as the friction unit 80 applies the frictional force $F_r$ to the upper eccentric bush 51 to prevent the upper eccentric bush 51 from slipping when the rotating shaft 21 rotates in the first direction, thus preventing the slippage and the collision.

As shown in FIG. 8, the friction members 83 of the friction unit 80 come into close contact with the inner circumferential surface of the upper eccentric bush 51, by the centrifugal force (not shown) generated when the rotating shaft 21 rotates at a high speed and the elastic force $F_e$ of the elastic member 82. By the centrifugal force and the elastic force $F_e$, the frictional force $F_r$ is applied from each of the friction members 83 to the inner circumferential surface of the upper eccentric bush 51, in a direction opposite to a rotating direction of the lower eccentric bush 52. Thus, the lower eccentric bush 52 rotates at the same speed as the rotating shaft 21 without slippage, by the frictional force $F_r$.

As described above, when the rotating shaft 21 rotates in the first or second direction, the friction unit 80 allows the upper or lower eccentric bush 51 or 52 to execute the compression operation in the upper or lower compression chamber 31 or 32 without the slippage.

According to the embodiment of the present invention, the friction unit is installed at the upper eccentric cam. However, without being limited to the embodiment, the friction unit may be installed at the lower eccentric cam or at both the upper and lower eccentric cams.

As is apparent from the above description, the present invention provides a variable capacity rotary compressor, which is designed to execute a compression operation in either of upper and lower compression chambers having different capacities by an eccentric unit which rotates in the first or second direction, thus varying a compression capacity of the compressor as desired.

Further, the present invention provides a variable capacity rotary compressor which has a friction unit provided at an upper eccentric cam, thus preventing an upper or lower eccentric unit from slipping even when there exists a variance of pressure in an upper or lower compression chamber during a forward or reverse rotation of an eccentric unit, therefore allowing the upper or lower eccentric bush to smoothly rotate.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, comprising:

upper and lower compression chambers having different capacities;

a rotating shaft passing through the upper and lower compression chambers;

upper and lower eccentric cams provided on the rotating shaft;

upper and lower eccentric bushes fitted over the upper and lower eccentric cams, respectively;

a slot provided at a predetermined position between the upper and lower eccentric bushes;

a locking pin to change a position of the upper or lower eccentric bush to a maximum eccentric position, in cooperation with the slot; and a friction unit installed at a predetermined portion of at least one of the upper and lower eccentric cams, to prevent the upper and lower eccentric bushes from slipping over the upper and lower eccentric cams, respectively.

2. The variable capacity rotary compressor according to claim 1, wherein the friction unit comprises:

a through hole formed through the upper eccentric cam in a radial direction thereof;

an elastic member set in the through hole; and a friction member provided at each of opposite ends of the elastic member to apply a frictional force to an inner circumferential surface of the upper eccentric bush.

3. The variable capacity rotary compressor according to claim 2, wherein the elastic member comprises a coil spring, the coil spring having an elastic force which is set to allow the frictional force acting on the upper eccentric bush to be larger than a slip-rotating force of the upper or lower eccentric bush and to be smaller than a rotating force of the rotating shaft.

4. The variable capacity rotary compressor according to claim 2, wherein the friction member comprises a curved outer surface which has a same curvature as the inner circumferential surface of the upper eccentric bush, to apply the frictional force to the upper eccentric bush.

5. The variable capacity rotary compressor according to claim 1, wherein the locking pin is provided at a predetermined position between the upper and lower eccentric cams to be projected from the rotating shaft, and the slot is provided at the predetermined position between the upper and lower eccentric bushes to receive the locking pin therein, and has a length to allow, an angle between a first line extending from a first end of the slot to a center of the rotating shaft and a second line extending from a second end of the slot to the center of the rotating shaft, to be approximately 180°.

6. A variable capacity rotary compressor, comprising:

upper and lower compression chambers having different capacities;

a rotating shaft passing through the upper and lower compression chambers;

upper and lower eccentric cams provided on the rotating shaft to be eccentric from the rotating shaft in a same direction;

upper and lower eccentric bushes fitted over the upper and lower eccentric cams, respectively, to be eccentric from the rotating shaft in opposite directions;

a slot provided at a predetermined position between the upper and lower eccentric bushes;

a locking pin to engage with a first or second end of the slot, according to a rotating direction of the rotating shaft, to change a position of the upper or lower eccentric bush to a maximum eccentric position; and a friction unit installed at a predetermined portion of either the upper or lower eccentric cam, to prevent the upper and lower eccentric bushes from slipping over the upper and lower eccentric cams, respectively.

7. The variable capacity rotary compressor according to claim 6, wherein the locking pin is provided at a predetermined position between the upper and lower eccentric cams to be projected from the rotating shaft, and the slot is provided at the predetermined position between the upper and lower eccentric bushes to receive the locking pin therein, and has a length to allow, an angle between a first line extending from the first end of the slot to a center of the rotating shaft and a second line extending from the second end of the slot to the center of the rotating shaft, to be approximately 180°.

8. The variable capacity rotary compressor according to claim 7, wherein the friction unit comprises:

a through hole formed through the upper eccentric cam in a radial direction thereof;

a coil spring set in the through hole; and a friction member provided at each of opposite ends of the coil spring to apply a frictional force to an inner circumferential surface of the upper eccentric bush.

9. The variable capacity rotary compressor according to claim 8, wherein the coil spring has an elastic force which is set to allow the frictional force acting on the upper eccentric bush to be larger than a slip-rotating force of the upper or lower eccentric bush and to be smaller than a rotating force of the rotating shaft.

10. The variable capacity rotary compressor according to claim 8, wherein the friction member comprises a curved outer surface which has a same curvature as the inner circumferential surface of the upper eccentric bush, to apply the frictional force to the upper eccentric bush.

11. A variable capacity rotary compressor, including compression chambers, a rotating shaft passing through the compression chambers, upper and lower eccentric cams provided on the rotating shaft, and upper and lower eccentric bushes fitted over the upper and lower eccentric cams, respectively, the rotary compressor comprising:

a slot at a predetermined position between the upper and lower eccentric bushes;

a locking pin to change a position of the upper or lower eccentric bush to a maximum eccentric position, in cooperation with the slot; and a friction unit at a portion of at least one of the upper and lower eccentric cams, to prevent the upper and lower eccentric bushes from slipping over the upper and lower eccentric cams, respectively.

12. The variable capacity rotary compressor according to claim 11, wherein the friction unit comprises:

a through hole formed through the upper eccentric cam in a radial direction thereof;

an elastic member, having opposite ends, set in the through hole; and a friction member at each of the opposite ends of the elastic member to apply a frictional force to an inner circumferential surface of the upper eccentric bush.

13. The variable capacity rotary compressor according to claim 12, wherein the elastic member comprises a coil spring.

14. The variable capacity rotary compressor according to claim 13, wherein the coil spring has an elastic force to allow the frictional force acting on the upper eccentric bush to be larger than a slip-rotating force of the upper or lower eccentric bush and to be smaller than a rotating force of the rotating shaft.

15. The variable capacity rotary compressor according to claim 12, wherein the friction member comprises a curved outer surface which has a same curvature as the inner circumferential surface of the upper eccentric bush, to apply the frictional force to the upper eccentric bush.

16. The variable capacity rotary compressor according to claim 11, wherein the locking pin is provided at a position between the upper and lower eccentric cams to be projected from the rotating shaft, and the slot is provided at a corresponding position between the upper and lower eccentric bushes to receive the locking pin.

17. The variable capacity rotary compressor according to claim 16, wherein the slot has a length to allow, an angle between a first line extending from a first end of the slot to a center of the rotating shaft and a second line extending from a second end of the slot to the center of the rotating shaft, to be approximately 180°.

* * * * *